US010279585B2

(12) United States Patent
Hoover et al.

(10) Patent No.: US 10,279,585 B2
(45) Date of Patent: May 7, 2019

(54) METHOD AND SYSTEM FOR ALIGNING EJECTORS THAT EJECT CLEAR MATERIALS IN A PRINTER

(71) Applicant: Xerox Corporation, Norwalk, CT (US)

(72) Inventors: Martin E. Hoover, Rochester, NY (US); Moritz P. Wagner, Rochester, NY (US); Ka Hei Fung, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/420,830

(22) Filed: Jan. 31, 2017

(65) Prior Publication Data

US 2018/0215143 A1 Aug. 2, 2018

(51) Int. Cl.

| | |
|---|---|
| ***B41J 2/045*** | (2006.01) |
| ***B41J 2/21*** | (2006.01) |
| ***B41J 25/00*** | (2006.01) |

(52) U.S. Cl.

CPC ..... *B41J 2/04505* (2013.01); *B41J 2/04586* (2013.01); *B41J 2/2114* (2013.01); *B41J 25/001* (2013.01)

(58) Field of Classification Search

None

See application file for complete search history.

(56) References Cited

U.S. PATENT DOCUMENTS

| | | | |
|---|---|---|---|
| 4,630,076 | A | 12/1986 | Yoshimura |
| 5,398,131 | A | 3/1995 | Hall et al. |
| 5,898,443 | A | 4/1999 | Yoshino et al. |
| 6,076,915 | A | 6/2000 | Gast et al. |
| 6,267,052 | B1 | 7/2001 | Hill et al. |
| 6,312,082 | B1 | 11/2001 | Lund et al. |
| 6,378,976 | B1 | 4/2002 | Byers et al. |
| 6,454,383 | B2 | 9/2002 | Lund et al. |
| 6,899,775 | B2 | 5/2005 | Hill et al. |
| 6,994,413 | B2 | 2/2006 | Otsuka et al. |

(Continued)

FOREIGN PATENT DOCUMENTS

| | | |
|---|---|---|
| EP | 1 764 226 A1 | 3/2007 |

OTHER PUBLICATIONS

European Patent Office; European Patent Search corresponding to European Application No./Patent No. 18151222.9-1019 / 3354469; 7 Pages.

*Primary Examiner* — Alejandro Valencia

(74) *Attorney, Agent, or Firm* — Maginot Moore & Beck LLP

(57) ABSTRACT

A printer is configured with an optical sensor that enables dashes in a test pattern formed with clear drops on a mirror-like surface to be detected and their positions identified. The optical sensor includes a louver positioned adjacent to a light source to limit and collimate an amount of light emitted by the light source onto each portion of the test pattern. The limiting of the light facilitates the processing of the image data generated by a plurality of photodevices that receive the specular light reflections from the mirror-like substrate and the test pattern to identify the positions of the dashes. These identified positions are compared to expected positions to identify misalignment distances that can be used to adjust ejector head alignment and timing of the firing signals to the ejector head that ejects clear drops.

8 Claims, 4 Drawing Sheets

(56) References Cited

U.S. PATENT DOCUMENTS

| | | | | |
|---|---|---|---|---|
| 7,101,017 | B2 | 9/2006 | Endo et al. | |
| 7,113,615 | B2 | 9/2006 | Rhoads et al. | |
| 7,321,614 | B2 | 1/2008 | Jacobsen et al. | |
| 7,533,982 | B2 | 5/2009 | Yoneyama | |
| 7,538,911 | B2 * | 5/2009 | Sakurai | H04N 1/02815 358/474 |
| 7,690,746 | B2 | 4/2010 | Mantell et al. | |
| 7,720,421 | B2 | 5/2010 | Snyder | |
| 7,959,252 | B2 | 6/2011 | Endo | |
| 8,506,038 | B2 | 8/2013 | Mizes et al. | |
| 8,939,536 | B2 | 1/2015 | Smith | |
| 9,438,760 | B2 * | 9/2016 | Uchiyama | H04N 1/00734 |
| 2004/0211904 | A1 * | 10/2004 | Scowen | B65H 7/14 250/341.1 |
| 2004/0258274 | A1 | 12/2004 | Brundage et al. | |
| 2006/0207452 | A1 | 9/2006 | Budach et al. | |
| 2006/0249039 | A1 | 11/2006 | Feldman et al. | |
| 2006/0284913 | A1 | 12/2006 | Takanose et al. | |
| 2007/0076050 | A1 | 4/2007 | Sugahara et al. | |
| 2008/0211866 | A1 | 9/2008 | Hill | |
| 2009/0040249 | A1 | 2/2009 | Wouters et al. | |
| 2009/0220750 | A1 | 9/2009 | Hill et al. | |
| 2009/0237434 | A1 | 9/2009 | Mantell et al. | |
| 2009/0267975 | A1 | 10/2009 | White et al. | |
| 2010/0053263 | A1 | 3/2010 | Yoshioka et al. | |
| 2010/0112223 | A1 | 5/2010 | Hill | |
| 2010/0225691 | A1 | 9/2010 | Wright et al. | |
| 2011/0037800 | A1 | 2/2011 | Tanoue et al. | |
| 2015/0062670 | A1 * | 3/2015 | Yoshida | G02B 6/0096 358/482 |
| 2016/0075153 | A1 * | 3/2016 | Reckefuss | B41F 33/0081 347/16 |
| 2016/0347081 | A1 * | 12/2016 | Fukasawa | B41J 2/16579 |

* cited by examiner

METHOD AND SYSTEM FOR ALIGNING EJECTORS THAT EJECT CLEAR MATERIALS IN A PRINTER

TECHNICAL FIELD

The system and method disclosed in this document relates to printing systems generally, and, more particularly, to systems and method for aligning ejectors to enable drop registration and defective ejector detection in the printing systems.

BACKGROUND

Two-dimensional (2D) and three-dimensional (3D) printers operate one or more ejectors to eject drops of material onto an image receiving member or platen. The material may be aqueous, oil, solvent-based, UV curable, emulsions, phase change, or other materials, particularly in three-dimensional (3D) object printers.

A typical printer uses one or more ejectors that can be organized in one or more printheads. The ejectors eject drops of material across an open gap to an image receiving member or platen. In a 2D printer, the image receiving member may be a continuous web of recording media, a series of media sheets, or the image receiving member may be a rotating surface, such as a print drum or endless belt. In a 3D printer, the platen can be a planar member on which an object is built layer by layer or a cylindrical member that rotates about the ejectors for formation of an object. Images printed on a rotating surface in a 2D printer are later transferred to recording media by mechanical force in a transfix nip formed by the rotating surface and a transfix roller. The ejectors can be implemented with piezoelectric, thermal, or acoustic actuators that generate mechanical forces that expel material drops through an orifice in response to an electrical voltage signal, sometimes called a firing signal. The amplitude, or voltage level, of the timing signals affects the amount of material ejected in each drop. The firing signals are generated by a controller in accordance with image or object layer data. A printer forms a printed image or object layer in accordance with the image data or object layer data by printing a pattern of individual drops at particular locations on the image receiving member or previously formed layers on the platen. The locations where the drops land are sometimes called "drop locations," "drop positions," or "pixels." Thus, a printing operation can be viewed as the placement of drops on an image receiving member or platen in accordance with image data or object layer data.

The ejectors in 2D and 3D printers must be registered with reference to the imaging surface or platen and with the other ejectors in the printer. Registration of ejectors is a process in which the ejectors are operated to eject drops in a known pattern and then the printed image of the ejected drops is analyzed to determine the orientation of the ejectors with reference to the imaging surface or previously formed layers and with reference to the other ejectors in the printer. Operating the ejectors in a printer to eject drops in correspondence with image data or object layer data presumes that the ejectors are level with a width across the image receiving member or previously formed layers and that all of the ejectors are operational. The presumptions regarding the orientations of the ejectors, however, cannot be assumed, but must be verified. Additionally, if the conditions for proper operation of the ejectors cannot be verified, the analysis of the printed image or layers should generate data that can be used either to adjust the operation of the ejectors so they better conform to the presumed conditions for printing or to compensate for the deviations of the ejectors from the presumed conditions.

Analysis of printed images is performed with reference to two directions. "Process direction" refers to the direction in which the image receiving member or platen is moving as the imaging surface or platen passes the ejectors to receive the ejected drops and "cross-process direction" refers to a direction that is perpendicular to the process direction in the plane of the image receiving member or platen. In order to analyze a printed image or layer, a test pattern needs to be generated so determinations can be made as to whether the ejectors operated to eject drops did, in fact, eject the drops and whether the ejected drops landed where the drops would have landed if the ejectors were oriented correctly with reference to the image receiving member or platen and the other ejectors in the printer.

Systems and methods exist for detecting drops ejected by different ejectors, inferring the positions and orientations of the ejectors, and identifying correctional data useful for moving one or more of the ejectors to achieve alignment acceptable for good registration in the printing system. The drops are ejected in a known pattern, sometimes called a test pattern, to enable one or more processors in the printing system to analyze image data of the test pattern on the drop receiving substrate for detection of the drops and determination of the ejector positions and orientation. In some printing systems, ejectors are configured to eject clear drops of material onto the receiving member or platen. This clear material is useful for adjusting gloss levels of the final printed product or the surface finish of a manufactured 3D object. Additionally, clear materials can be used to form optical structures, such as lenses on a surface of a 3D object, or to form support structures during the building of a 3D object. As used in this document, the term "clear" refers to a material that has a low or no concentration of colorant in it. One issue that arises from the use of clear material, however, is the difficulty in detecting drops of clear material ejected onto a receiving member with an imaging system. Because the clear drops do not image well, the known systems and methods for aligning ejectors do not enable the clear drops to be detected and the positions and orientations of the ejectors ejecting clear material to be inferred.

In one known system and method for aligning ejectors, the test pattern is formed with the drops ejected from the ejectors forming dashes. The dashes in the test pattern are illuminated by a light source, such as a fluorescent lamp or a light tube that extends across the width of the drop receiving member in the cross-process direction. An image sensor having a plurality of light receivers, such as photodetectors, receives the light reflected from the receiving member. As the receiving member moves past the light source and receiver in the process direction, the light is generally collimated. But in the cross-process direction, the light reflected from the image receiving member that is picked up by the light receivers can come from the whole width of the light source. This type of light leads to the edges of the dashes of clear material in the test pattern looking like the background so detecting the dashes in the image of the test pattern is difficult. This obfuscation is especially present when the clear materials are ejected on shiny or mirror-like surfaces, which are useful for detecting a wide range of colored materials and uncolored materials. Therefore, development of a system and method for aligning ejectors that can detect dashes of clear material, particularly on shiny or mirror-like substrates, in a test pattern is a desirable goal.

SUMMARY

A method of operating a printing system enables ejectors that eject clear material to be aligned with ejectors that eject visibly colored material. The method includes printing a test pattern having dashes formed with drops of clear material ejected by at least one ejector head onto a substrate as the substrate moves in a process direction past the at least one ejector head that ejects the drops of clear material, directing light generated by a light source through a louver positioned adjacent the light source onto the test pattern on the substrate, generating electrical signals with photosensitive devices that correspond to an amount of specular light reflected from a portion of the substrate or the test pattern, identifying positions of the dashes in the test pattern with reference to the generated electrical signals, identifying with reference to the identified positions at least one misalignment distance for the at least one ejector head that ejects the clear drops, and operating with a controller at least one actuator operatively connected to the at least one ejector head that ejects clear drops, the controller operating the at least one actuator with reference to the identified at least one misalignment distance to adjust alignment in a cross-process direction of the at least one ejector head that ejects clear drops.

A printer is configured to enable ejectors in the printer that eject clear material to be aligned with ejectors that eject visibly colored material. The printer includes at least one ejector head having an array of ejectors from which clear drops are ejected, at least one actuator operatively connected to the at least one ejector head that ejects clear drops, a light source, a louver positioned adjacent the light source, a plurality of photosensitive devices, each photosensitive device being configured to generate an electrical signal that corresponds to an amount of light received by the photosensitive device, and a controller operatively connect to the at least one ejector head that ejects clear drops, the at least one actuator, the light source, and the plurality of photosensitive devices. The controller is configured to operate the at least one ejector head that ejects clear drops to print a test pattern having dashes formed with clear material drops on a substrate as the substrate moves in a process direction past the at least one ejector head that ejects the clear drops, to operate the light source to direct light through the louver onto the test pattern of dashes on the substrate, to receive from the photosensitive devices the generated electrical signals that correspond to the amount of light received by the photosensitive devices, to identify positions of the dashes in the test pattern with reference to the generated electrical signals received from the photosensitive devices, identify with reference to the identified positions at least one misalignment distance for the at least one ejector head that ejects the clear drops, and operate the at least one actuator with reference to the identified at least one misalignment distance to adjust alignment in the cross-process direction of the at least one ejector head that ejects clear drops.

BRIEF DESCRIPTION OF THE DRAWINGS

An exemplary embodiment of this application is described below, by way of example, with reference to the accompanying drawings, in which like reference numerals refer to like elements, and in which.

DETAILED DESCRIPTION

Figure 1:
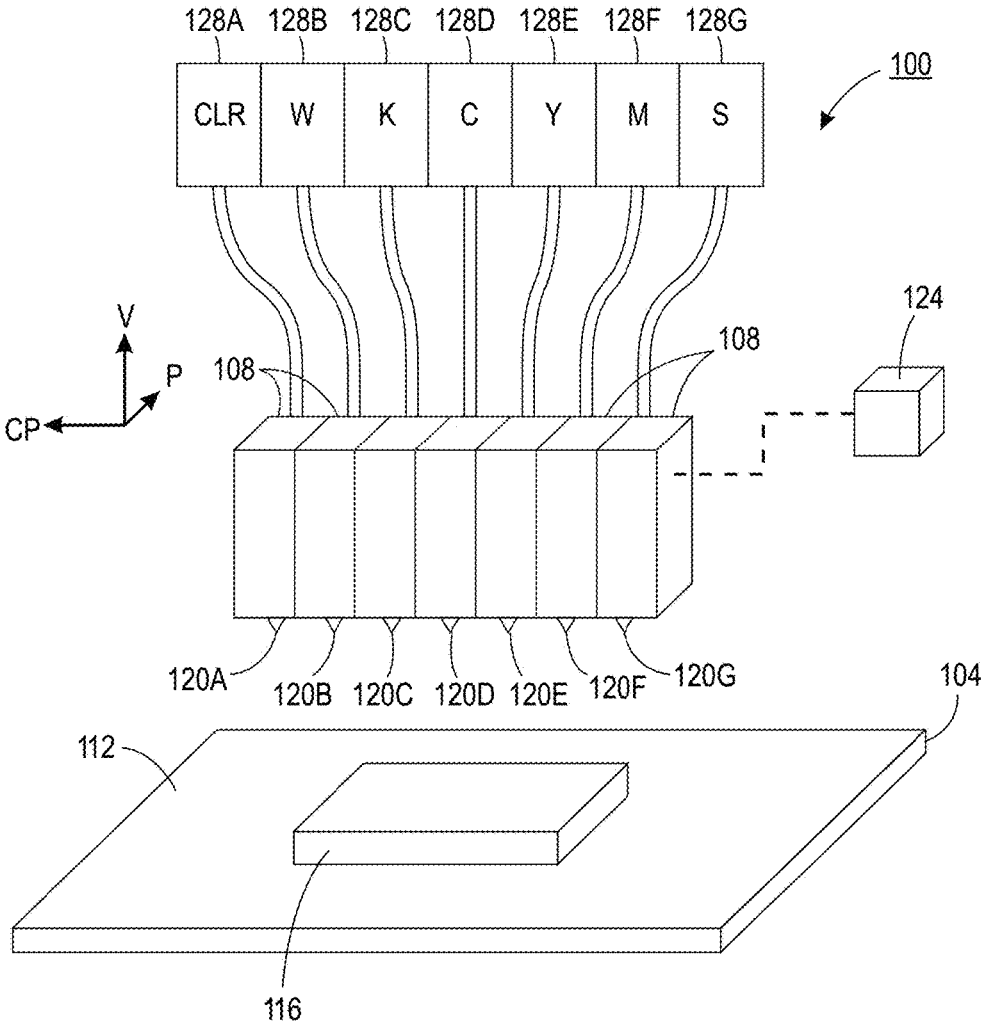
FIG. 1 is a schematic view of an improved printing system that ejects drops of material onto a platen to form an object in which the improved optical sensor is used.

For a general understanding of the environment for the method and printer disclosed herein as well as the details for the method and printer, reference is made to the drawings. In the drawings, like reference numerals designate like elements.

FIG. 1 shows a three-dimensional (3D) object printer 100. The printer 100 comprises a platen 104 and a plurality of ejector heads 108. The ejector heads 108 are configured with one or more actuators to enable independent movement of each ejector head in the process direction, cross-process direction, and vertical direction as explained further below to register the ejectors of each ejector head with the ejectors of the other ejector heads. Thereafter, the ejector heads 108 are moved together as a block to maintain the registration of the ejectors in the ejector heads. Each ejector head 108 has one or more ejectors configured to eject drops of build material towards a surface 112 of the platen 104 to form a three-dimensional object, such as the object 116. The ejectors 120A-F are configured to eject drops of a build material to form a three-dimensional object. In some embodiments, an ejector head 108 has at least one ejector 120G configured to eject drops of a support material, such as wax, to form support for the object 116 being formed. As used in this document, "support" means one or more layers of support material that enable layers of build material for a portion of the object to be formed without gravity or laminar flow of the build material causing deformation. This support material is later removed from the finished part. The particular arrangement of the ejectors 120A-G in the ejector heads 108 shown in FIG. 1 is merely for illustrative purposes. In some embodiments, the ejectors 120A-G in each of the ejector heads 108 may be arranged in several rows or columns. The ejector heads 108 are configured to move as a group relative to the platen 104 in the process direction P, the cross-process direction CP, and the vertical direction V. In some embodiments, the printer 100 includes actuators configured to move one or both of the ejector heads 108 and the platen 104 with respect to one another in these directions.

The printer 100 includes a controller 124 operatively connected to at least the ejector heads 108 and the actuators that move the ejector heads. The controller 124 is configured to operate the ejector heads 108 with reference to image data that has been transformed into object layer data to form a three-dimensional object on the platen surface 112. In some embodiments, the image data comprise a three-dimensional model that indicates a shape and size of an object to be formed. To form each layer of the three-dimensional object, the controller 124 operates actuators of the printer 100 to sweep the ejector heads 108 one or more times in the process direction P, while ejecting drops of material towards the platen 104. In the case of multiple passes, the ejector heads 108 shift in the cross-process direction CP between each sweep. After each layer is formed, the ejector heads 108 move away from the platen 104 in the vertical direction V to begin printing the next layer.

To enable the printer 100 to print three-dimensional objects in full color, the printer 100 includes a plurality of material supplies 128A-G operably connected to the ejector heads 108 in a one-to-one correspondence and they are configured to feed different materials to the ejectors 120A-G of the ejector heads 108. In the exemplary embodiment shown, the material supply 128A supplies a clear or transparent build material to at least one ejector 120A of one of the ejector heads 108. The material supply 128B supplies a white build material to at least one ejector 120B of one of the ejector heads 108. The material supply 128C supplies a black build material to at least one ejector 120C of one of the ejector heads 108. The material supply 128D supplies a cyan build material to at least one ejector 120D to one of the ejector heads 108. The material supply 128E supplies a yellow build material to at least one ejector 120E of one of the ejector heads 108. The material supply 128F supplies a magenta build material to at least one ejector 120F of one of the ejector heads 108. Finally, the material supply 128G supplies a support material, such as wax, to at least one ejector 120G of one of the ejector heads 108. As noted above, the particular arrangement of the ejectors 120A-G shown in FIG. 1 is merely for illustrative purposes. In some embodiments, each of the material supplies 128A-G is configured to feed a plurality of ejectors arranged in one or more rows or columns.

Figure 2:
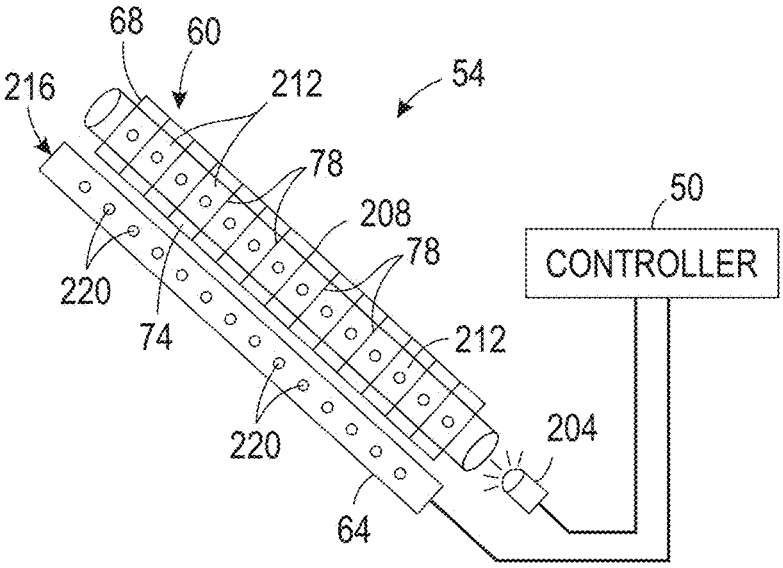
FIG. 2 is a depiction of one embodiment of the optical sensor in the system of FIG. 1.
Figure 3:
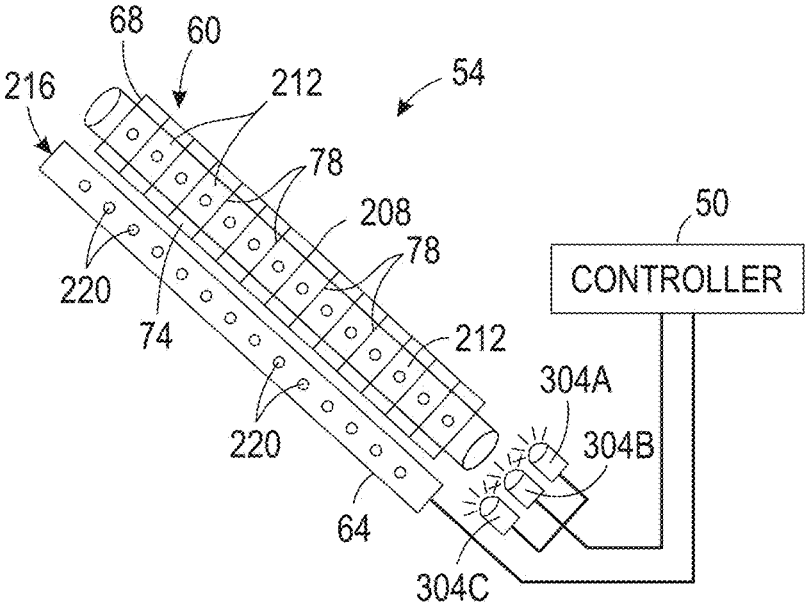
FIG. 3 is a depiction of another embodiment of the optical sensor in the system of FIG. 1.

The printing system 100 includes an optical imaging system 54 for verifying the registration of the ejector heads 108. The optical imaging system 54 shown in FIG. 2 is configured with a light source 60, a light detector 64, and a louver 68 to enable clear drops as well as colored drops to be imaged on the platen 104 or a substrate placed on the platen 104. The optical imaging system 54 is configured to generate an image of the drops on the media to enable detection of, for example, the presence, intensity, and location of drops jetted onto the platen 104 or substrate placed on the platen 104 by the ejectors of the ejector heads 108. In the embodiment shown in FIG. 2, the light source 60 for the optical imaging system 54 is a single light emitting diode (LED) 204 that is coupled to a light pipe 208 that conveys light generated by the LED to openings 212 in the light pipe. As used in this document, the term "light pipe" means a structure that enables light to pass through the structure from one end to the other and be emitted at openings between the two ends. The openings 212 direct light towards the image substrate. In another embodiment of optical imaging system 54 shown in FIG. 3, three LEDs, 304A, 304B, and 304C are positioned to direct light into the light pipe 208. LED 304A generates green light, LED 304B generates red light, and LED 304C generates blue light. These LEDS are selectively activated by the controller 50 so light from only one LED is directed into the light pipe at a time and subsequently directed towards the image substrate. In the embodiments of FIG. 2 and FIG. 3, each light pipe extends across the path of the media in the cross-process direction at a distance that is at least as wide as the widest media that travels through the system 100. The LEDs of the light source in the embodiments shown in FIG. 2 and FIG. 3 are operatively connected to the controller 50 or some other control circuitry to activate the LEDs for image illumination.

The reflected light is measured by the light detector 64 in optical sensor 54. In the embodiments of FIG. 2 and FIG. 3, the light detector 64 is a linear array 216 of photosensitive devices 220, such as charge coupled devices (CCDs). Each photosensitive device 220 generates an electrical signal corresponding to the intensity or amount of specular light reflected by the media and the material drops on the media to the photosensitive devices. These signals are received by the controller 50 and processed as image data to detect the edges of the dashes in the test pattern. In the embodiments depicted in the figures, the linear array extends substantially across the width of the media path at a distance that corresponds to the widest media to travel past the ejector heads.

Figure 4:
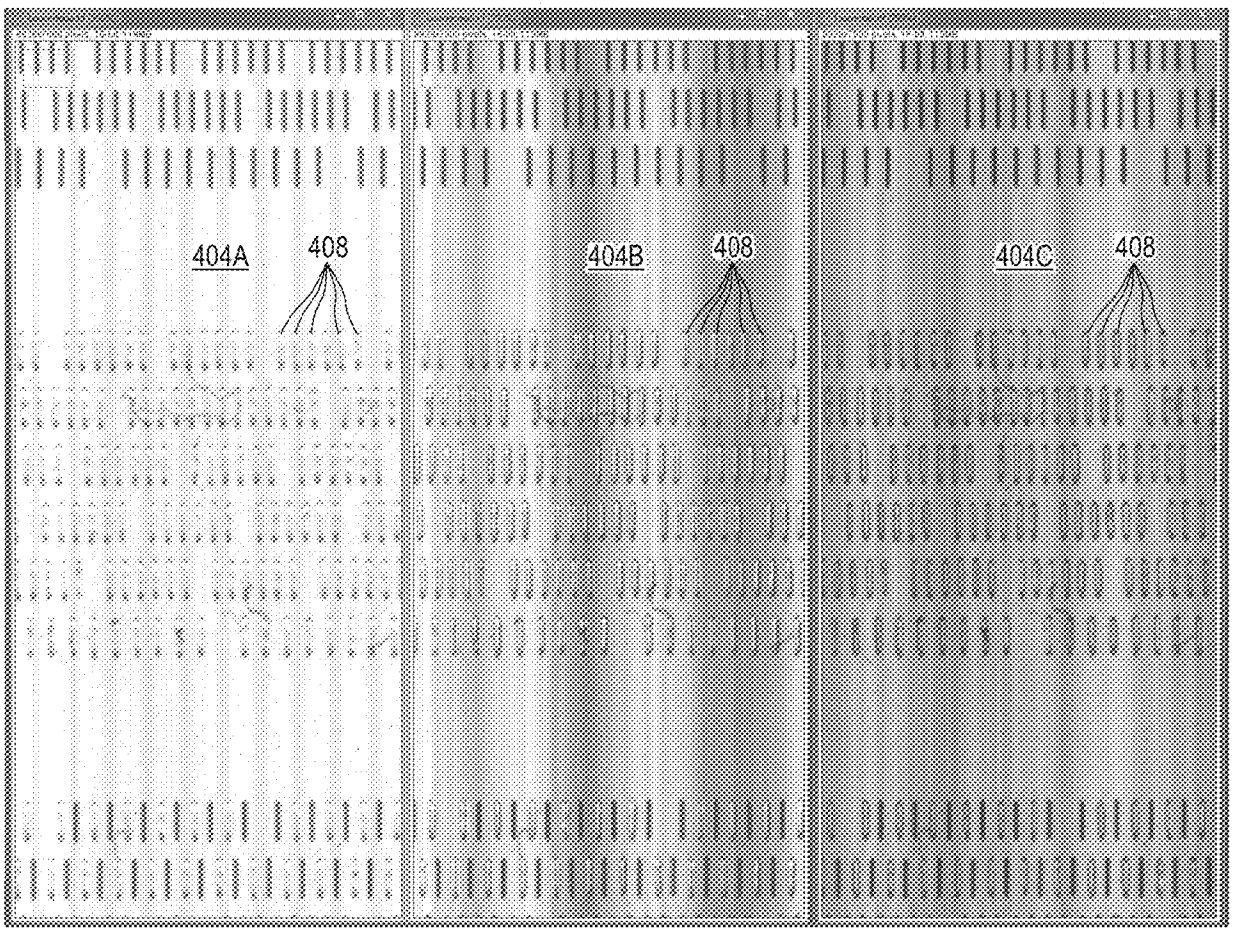
FIG. 4 is an illustration of the differences in images of a test pattern imaged without and with the louver of the optical sensor in the system shown in FIG. 1.
Figure 5:
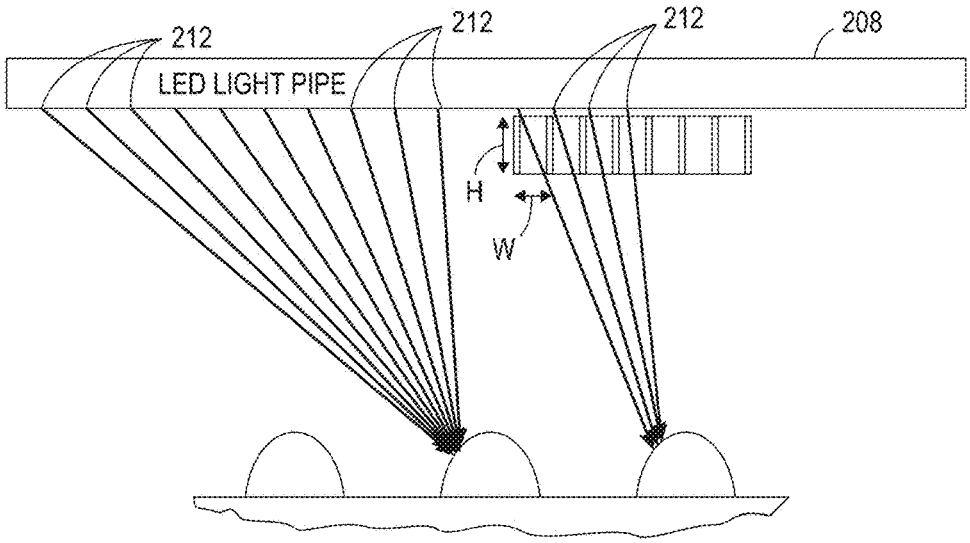
FIG. 5 depicts the difference in the light emitted from the light source of the optical sensor of FIG. 2 or FIG. 3 with and without a louver.

As shown in FIG. 4, areas 404A, 404B, and 404C have been printed with drops of clear material to form dashes 408 on a substrate of mirror-like material on the platen 104. The mirror-like material can be an aluminized mylar sheet that helps enhance the detection of clear and white drops from the specular reflections from the sheet as explained more fully below. Area 404A has been imaged with an optical sensor, such as optical sensor 54 described above, that does not include the louver 684 described below. The edges of the dashes 408 in area 404A are difficult to detect in image processing because the light emitted from the light pipe in the cross-process direction is not strongly collimated as noted above. As used in this document, the term "dash" refers to a predetermined number of drops ejected from a single ejector as either the ejector head or a platen is move so the drops form an elongated series of drops on the receiving surface. In each of the embodiments of the optical sensor 54 shown in FIG. 2 and FIG. 3, a louver 68 is included. As used in this document, the term "louver" means a set of slats or strips positioned at regular intervals to enable light to pass through the slats or strips. The louver 68 has two parallel members 74 and a plurality of cross-members 78 that extend between the parallel members 74. The cross-members have a height that extends from the surface of the light pipe in a direction that is perpendicular to the plane formed by the light pipe. Additionally, the cross-members 78 are separated by a distance that corresponds to a width of an opening in the light pipe in the cross-process direction. As shown in FIG. 5, the cross-members 78 of the louver 68 reduce the number of light rays directed to a drop of clear material and collimate the light to enhance the intensity of the specular reflections received by the photosensitive devices in the light detector 64 for the generation of the electrical signals that enable the controller 50 processing the image of the dashes to distinguish between the edges of the drops and the background media. The portion of FIG. 5 to the left of the louver 68 demonstrates the less collimated light that strikes the drops of the test pattern when the louver 68 is not present.

In particular, the height/width ratio and pitch of the louver are important properties for collimating light from the pipe towards the test pattern. "Pitch" refers to the number of slats per unit distance in a louver. The higher the pitch, the greater the collimation of the light with an improved ability to detect the edges of dashes formed with drops of material. As the pitch increases, so should the ratio of the height to the width. For example, a height to width ratio of 2 is usually adequate, but as the pitch increases, that is, as the number of slats increases, so should the height of the slats increase so the ratio becomes 3. The increase in the pitch along with the commensurate increase in the height/width ratio improves the uniformity of the light impinging on the test pattern with a subsequent reduction in the amount of scattered light that reaches the photodetectors.

With continued reference to FIG. 4, area 404B depicts an image of clear material dashes generated with emitted light through a louver 68 that has a cross-member height that is less than the cross-members of the louver 68 used to image area 404C. As can be ascertained from the figure, the louver 68 having the cross-members with the greater height produces an image of the dashes that facilitates the detection of the clear material dashes. By imaging clear material dashes with an optical sensor 54 having a louver 68 with different cross-member heights, an optimal height for the cross-members can be identified and used in a printing system.

A method of printing test patterns with at least one color material and the clear material in the printing system 100 described above enables a printing system operator to evaluate alignment of the ejector head ejecting clear material with the other ejector heads and to enter data into a system that operates actuators to adjust the position of the ejector heads in the printing system. The method requires a test pattern of dashes to be printed with clear drops and with drops from at least one other ejector head in the system 100. The test pattern is then imaged with an optical sensor having the louver 68 positioned over the light pipe openings to limit and collimate the light rays striking the dashes in the test pattern and the media. This limitation and collimation reduces the amount of scattered light from the background that enters the photosensitive devices that generate the signals used to produce the image data. Consequently, the image processor receiving the image data can identify the dash edges in the image of the test pattern and compare those positions to the expected positions for the dash edges to identify misalignment distances for one or more ejector heads. These misalignment distances are then used by a controller within the printer to operate one or more actuators operatively connected to the one or more ejector heads that eject drops of material in the test pattern to realign the ejector heads.

Specifically, in one embodiment, the image data of the dashes on the platen are analyzed to detect the X and Y positions of each dash and the average of these positions for a number of dashes is used to determine the position of the ejector head. This position is used to align the ejector head with other ejector heads. This alignment is used to stitch ejector heads to provide a full width array of ejectors or to register drops from different ejector heads for color to color registration. Individual dash positions are also used to normalize pixel placement across and ejector head. Such normalization corrections include adjusting the voltage of the waveforms used to drive the ejectors to normalize the volumes or masses of ejected drops and to adjust drop placement in the Y or process direction.

Figure 6:
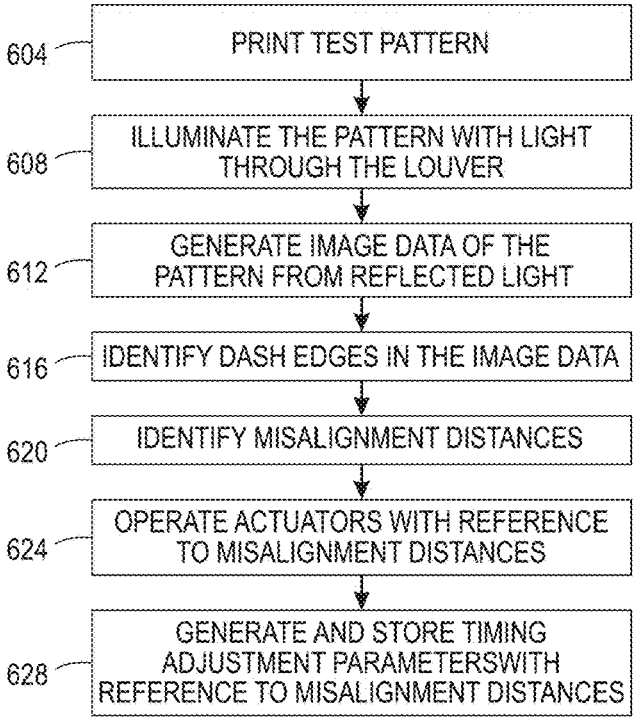
FIG. 6 is a flow diagram of a process that enables ejectors that eject clear material to be aligned with ejectors that eject visibly colored material.

A method 100 that enables ejector heads that eject clear drops to be aligned to ejector heads that eject colored drops in a printer is shown in FIG. 6. A controller in the printer operates one or more ejector heads to print a test pattern of dashes, at least some of which are formed with clear material drops (block 604). As the printed test pattern passes by the optical sensor 54, the substrate on which the test pattern has been printed is illuminated by light source 60 through the louver 68 (block 608) and the light detector 64 generates electrical signals from the specular light reflected by the media and the dashes to produce image data of the test pattern on the media (block 612). An image processor receiving the image data can identify the dash edges in the image of the test pattern (block 616) and compare those positions to the expected positions for the dash edges to identify misalignment distances in the process and cross-process directions for one or more ejector heads (block 620). The misalignment distances in the cross-process direction are used by a controller within the printer to operate one or more actuators operatively connected to the one or more ejector heads to realign the ejector heads (block 624). The identified misalignment process direction distances are stored in memory and used by the controller to compute time adjustment parameters that are subsequently used to retard or advance the application of the firing signals to the ejectors within an ejector head to compensate for the process direction distance misalignment (block 628).

Because specular reflections from the dashes in the test pattern more effectively enable detection of the dash edges, a shiny mirror substrate, such as aluminized mylar, is placed on the platen 104 for the printing of the test pattern. Other types of mirror-like substrates include polished stainless steel sheets, polished aluminum plates, chrome-plated sheets, or glass sheets. These types of sheets can be cleaned and reused, while the aluminized mylar is a disposable commodity. As used in this document, a "mirror-like surface" refers to a surface that predominantly produces specular, rather than diffuse, reflections of light incident on the surface. A mirror-like surface enables the detection of the dashes to be more independent of the color or diffuse reflections. This type of surface is useful for detecting uncolored materials, such as clear materials, as well as for detecting colored materials that are similar to the substrate color. For example, white or lightly colored material drops, such as yellow drops, are difficult to detect on white or lightly colored backgrounds and so are black or darkly colored material drops on black or darkly colored backgrounds. The mirror-like surface of the substrate is highly specular and, in some cases, so are the clear material drops or the material drops that are similar to the substrate color. Thus, clear drops or similarly colored drops ejected onto a mirror-like surface form dome or hump-shaped marks that refract or scatter the specular reflections. Each dash on the shiny surface acts as a lens that concentrates the light striking the dash. This concentration can cause the centers of the dash to appear brighter than the shiny surface in the background.

To detect these dashes, a light source is required that provides good uniformity in the specular reflections produced by the dashes so a light pipe or a florescent tube lamp is used since these sources provide uniform light at all angles emitted from the openings in the pipe or from the tube surface. To further enhance the contrast between the light reflections from the dashes and the light reflections from the shiny surface, the louver is positioned adjacent the light pipe or florescent tube to collimate the light that produces the specular reflections to the detectors positioned at the detection angles. That is, the detectors are positioned at locations that are along the angle of reflection related to the angle of incidence. Thus, the uniform light source and the louver of the optical imaging sensor 54 enables detection of clear material on shiny surfaces as well as white or black drops, which are difficult to detect on surfaces that do not contrast significantly with the drops. Such a system enables a wide range of colored and uncolored material drops to be detected without relying on a stark contrast between the colors of the material drops and the substrate forming the background.

In operation, a printer is configured to implement the process described above. The controller of the printer operates a group of ejector heads that eject clear drops and colored drops to print the test pattern having dashes formed with clear material drops after the ejector heads that ejected colored drops have been registered using known methods. The misalignment distances for the ejector heads that eject clear drops are used to operate actuators to correct the cross-process positions of the ejector heads and to generate and store the timing adjustment parameters for process direction correction. Only if misregistration of the clear drops to the colored drops is perceived during a print run does another test pattern need to printed and analyzed for ejector head alignment.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A printer comprising:

at least one ejector head having an array of ejectors from which clear drops are ejected toward a media path opposite the at least one ejector head;

at least one actuator operatively connected to the at least one ejector head that ejects clear drops;

a light source having a plurality of light emitters arranged in a continuous linear array across a width of the media path in a cross-process direction, the light source being positioned to direct light toward the media path at an angle of incidence;

a louver positioned adjacent the plurality of light emitters in the light source, the louver having a pair of members and a plurality of cross-members, the pair of members are parallel to one another and extend in the cross-process direction and the cross-members are parallel to a process direction and extend between the pair of members so that a single cross-member is between adjacent light emitters in the light source to enable the louver to collimate the light from each light emitter in the light source as the light passes directly from the light source through the louver, a ratio of a height of each cross-member extending away from a surface of each light emitter in the light source in a direction toward the media path to a distance between adjacent cross-members is at least two;

a plurality of photosensitive devices offset from the light source in the process direction and arranged in a continuous linear array across the width of the media path, the plurality of photosensitive devices being positioned at an angle of reflection with reference to the angle of incidence of the light emitted from the light emitters of the light source, each photosensitive device being configured to generate an electrical signal that corresponds to an amount of light received by the photosensitive device; and a controller operatively connect to the at least one ejector head that ejects clear drops, the at least one actuator, the light source, and the plurality of photosensitive devices, the controller being configured to operate the at least one ejector head that ejects clear drops to print a test pattern having dashes formed with clear material drops on a substrate as the substrate moves along the media path in the process direction past the at least one ejector head that ejects the clear drops, to operate the light source to direct light through the louver onto the test pattern of dashes on the substrate, to receive from the photosensitive devices the generated electrical signals that correspond to the amount of light received by the photosensitive devices, to identify positions of the dashes in the test pattern with reference to the generated electrical signals received from the photosensitive devices, to identify with reference to the identified positions at least one misalignment distance for the at least one ejector head that ejects the clear drops, and operate the at least one actuator to move the at least one ejector head with reference to the identified at least one misalignment distance to adjust alignment in a cross-process direction of the at least one ejector head that ejects clear drops.

2. The printer of claim 1, the light source further comprising:

a light pipe having a first end and a second end and a plurality of openings along the light pipe between the first end and the second end to form the light emitters; and at least one light emitting diode (LED) that directs light into one end of the light pipe to enable light to be emitted from the openings in the light pipe and pass through the louver.

3. The printer of claim 2, wherein each opening in the light pipe is positioned between adjacent cross-members in the louver.

4. The printer of claim 1, the light source further including:

a florescent tube positioned with reference to the louver to enable light emitted from the florescent tube to pass through the louver.

5. The printer of claim 3, the controller being further configured to:

identify a distance indicative of misalignment of the at least one ejector head in the process direction.

6. The printer of claim 5, the controller being further configured to:

generate a timing adjustment parameter with reference to the distance indicative of misalignment of the at least one ejector head in the process direction; and store the generated timing adjustment parameter in memory.

7. The printer of claim 6, the controller being further configured to:

generate firing signals for ejectors in the at least one ejector head with reference to the stored generated timing adjustment parameter.

8. The printer of claim 1 wherein the substrate is a mirror-like substrate.

* * * * *